US006629822B2

(12) United States Patent
Larkin et al.

(10) Patent No.: US 6,629,822 B2
(45) Date of Patent: Oct. 7, 2003

(54) INTERNALLY SUPERCHARGED AXIAL PISTON PUMP

(75) Inventors: Bruce Larkin, Plainwell, MI (US); John Jones, Kalamazoo, MI (US); Vaughn Ryan Gerber, Kalamazoo, MI (US)

(73) Assignee: Parker Hannifin Corporation, Cleveland, OH (US)

( * ) Notice: Subject to any disclaimer, the term of this patent is extended or adjusted under 35 U.S.C. 154(b) by 0 days.

(21) Appl. No.: 10/038,047

(22) Filed: Nov. 9, 2001

(65) Prior Publication Data

US 2003/0084784 A1 May 8, 2003

Related U.S. Application Data

(60) Provisional application No. 60/247,277, filed on Nov. 10, 2000.

(51) Int. Cl.[7] ..... F04B 23/08

(52) U.S. Cl. ..... 417/203; 417/205; 417/269; 92/71

(58) Field of Search ..... 417/201, 203, 417/205, 269, 222.1, 222.2; 92/71

(56) References Cited

U.S. PATENT DOCUMENTS

| | | | | | |
|---|---|---|---|---|---|
| 3,202,101 | A | * | 8/1965 | Tinker et al. | 417/53 |
| 3,250,227 | A | | 5/1966 | Kouns | |
| 3,667,867 | A | | 6/1972 | Boydell et al. | |
| 3,669,568 | A | * | 6/1972 | McLeod | 417/203 |
| 3,690,789 | A | * | 9/1972 | Spence | 417/203 |
| 3,774,505 | A | | 11/1973 | McLeod | |
| 4,014,628 | A | | 3/1977 | Ruseff et al. | |
| 4,037,521 | A | | 7/1977 | McLeod | |
| 4,212,596 | A | | 7/1980 | Ruseff | |
| 4,223,594 | A | | 9/1980 | Gherner | |
| 4,281,971 | A | | 8/1981 | Kouns | |
| 4,366,672 | A | | 1/1983 | Claar et al. | |
| 4,934,253 | A | | 6/1990 | Berthold et al. | |
| 5,123,815 | A | | 6/1992 | Larkin et al. | |
| 5,176,066 | A | | 1/1993 | Kanamaru et al. | |
| 5,251,536 | A | | 10/1993 | Engel | |
| 5,538,401 | A | | 7/1996 | Schaffner et al. | |
| 5,647,266 | A | | 7/1997 | Claas | |
| 6,022,198 | A | * | 2/2000 | Hoffmeister | 417/203 |
| 6,244,160 | B1 | * | 6/2001 | Kunze | 92/57 |

* cited by examiner

*Primary Examiner*—Charles G. Freay
(74) *Attorney, Agent, or Firm*—Renner, Otto, Boisselle & Sklar, LLP

(57) ABSTRACT

An axial piston pump that enables fluid entering the pump to be pre-charged without the addition of an auxiliary pumping mechanism or other type of external fluid precharge, comprises a housing having a cylindrical inner wall surface surrounding a barrel chamber, a barrel mounted for rotation within the barrel chamber in the housing and having a plurality of circumferentially spaced piston bores therein, and a plurality of pistons reciprocally movable in the piston bores for pumping fluid from a delivery passage to an exhaust passage. The barrel has at least one and preferably plural impeller vanes projecting radially outwardly and terminating at a radially outer vane edge adjacent the inner wall surface of the barrel chamber. Upon rotation of the barrel, the impeller vanes function to supercharge the fluid supplied to the piston bores.

21 Claims, 3 Drawing Sheets

INTERNALLY SUPERCHARGED AXIAL PISTON PUMP

This application claims the benefit of U.S. Provisional Application No. 60/247,277 filed Nov. 10, 2000, which is hereby incorporated herein by reference in its entirety.

FIELD OF THE INVENTION

The invention herein described relates generally to axial piston pumps and, more particularly, to an internally supercharged axial piston pump.

BACKGROUND OF THE INVENTION

An axial piston pump has a barrel rotatably mounted within a pump housing. The barrel includes a plurality of circumferentially equally spaced bores in which pistons reciprocate. Each piston bore has a port in the end of the barrel that lies against a port plate that contains delivery and exhaust ports. As the barrel rotates, each piston bore port sequentially traverses the delivery and exhaust ports. As each piston bore port traverses the delivery port low pressure fluid is drawn into the piston bore. When the piston bore port traverses the exhaust port, fluid is expelled at an increased pressure.

The speed at which an axial piston pump may be run is limited by the rate at which fluid at the delivery port fills the piston bores during the pumping operation. If the piston bores are not filled with fluid as they traverse the delivery port, cavitation occurs, power is lost and severe damage to the pump may occur. Heretofore, booster pumps have been used to pressurize the fluid at the pump inlet in order to increase the filling speed of the piston bores and thereby increase the speed at which the pump may be operated. Booster pumps, however, add to cost and also occupy space which may be at a premium. Furthermore, booster pumps are commonly operated to increase the fill rate of the incoming fluid to a level sufficient to fill the barrel bores at the maximum operating speed of the pump. However, since a pump is not always operated at its maximum speed, the booster pump is providing supercharged fluid at a greater pressure than is necessary for a portion of the time the pump is operating, which results in wasted energy.

SUMMARY OF THE INVENTION

The present invention provides an axial piston pump that enables fluid entering the pump to be pre-charged without the addition of an auxiliary pumping mechanism or other type of external fluid precharge. The axial piston pump comprises a housing having a cylindrical inner wall surface surrounding a barrel chamber, a barrel mounted for rotation within the barrel chamber in the housing and having a plurality of circumferentially spaced piston bores therein, and a plurality of pistons reciprocally movable in the piston bores for pumping fluid from a delivery passage to an exhaust passage. In accordance with the invention, the barrel has at least one and preferably plural impeller vanes projecting radially outwardly and terminating at a radially outer vane edge adjacent the inner wall surface of the barrel chamber. Upon rotation of the barrel, the impeller vanes function to supercharge the fluid supplied to the piston bores.

In a preferred embodiment, the piston barrel comprises a core including the piston bores, and a sleeve surrounding the core, the sleeve including a cylindrical hub portion, and the impeller blade or blades projecting radially outwardly from the hub portion. The hub portion and the impeller blade or blades preferably are formed as a unitary piece, as by molding from plastic.

More particularly, the present invention provides an axial piston fluid pump comprising a housing having an inner wall surface surrounding a barrel chamber and a port surface at a first end of the barrel chamber, the port surface including a delivery port and an exhaust port circumferentially spaced apart in relation to a center axis of the barrel chamber; a barrel rotatably mounted within the barrel chamber in the housing and having a plurality of axially extending; circumferentially spaced piston bores therein, each piston bore having associated therewith a cylinder port in an end wall of the barrel located adjacent the port surface which cylinder port sequentially communicates with the delivery and exhaust ports during rotation of the barrel in the barrel chamber; a plurality of pistons disposed in the piston bores for reciprocation; and a drive shaft for rotatably driving the barrel in the barrel chamber. The housing further includes an inlet passage for delivering low pressure fluid to a second end of the barrel chamber opposite the port surface. In accordance with the invention, the barrel has a radially outer surface radially inwardly spaced from the inner wall surface of the barrel chamber to form an impeller pump chamber, and at least one and preferably a plurality of impeller vanes project radially outwardly from the outer wall surface of the barrel and terminate at a radially outer vane edge adjacent the inner wall surface of the barrel chamber. The impeller pump chamber has an inlet end in fluid communication with the second end of the barrel chamber and an outlet end in fluid communication with the delivery port, whereby upon rotation of the barrel in the barrel chamber, low pressure fluid from the second end of the barrel chamber is supercharged by the impeller vane prior to passage through the delivery port.

In a preferred embodiment, the drive shaft passes through the center of the barrel. The barrel may be axially slidable on the shaft and axially biased against the port surface. The drive shaft may be rotatably supported in the housing by bearings at opposite ends of the housing, which bearings carry the hydraulic loading acting on the barrel as is preferred.

In a preferred embodiment, the impeller vanes are circumferentially equally spaced around the barrel. Each vane preferably has a helical portion and an axial portion, and none of the vanes axially overlap an adjacent vane, as is desirable to facilitate molding of the vanes. According to another embodiment, each vane may be helical and of progressively increasing circumferential width going from the inlet to the outlet end of the impeller pump chamber, whereby the circumferential spacing between relatively adjacent vanes progressively decreases going from the inlet to the outlet end of the impeller pump chamber.

In a preferred embodiment, the port surface further has an annular discharge groove at the outlet end of the impeller pump chamber for receiving supercharged fluid and directing the supercharged fluid to the delivery port. The discharge groove preferably is connected to the delivery port by a volute, and the discharge groove preferably progressively increases in cross-sectional area in the direction of rotation of the barrel.

According to another aspect of the invention, a piston barrel for an axial piston pump comprises a core including a plurality of circumferentially spaced piston bores, and a sleeve surrounding the core, the sleeve including a cylindrical hub portion and at least one impeller blade projecting radially outwardly and termination at a radially outer vane edge.

The foregoing and other features of the invention are hereinafter fully described and particularly pointed out in the claims, the following description and the annexed drawings setting forth in detail one or more illustrative embodiments of the invention, such being indicative, however, of but one or a few of the various ways in which the principles of the invention may be employed.

DETAILED DESCRIPTION

Figure 1:
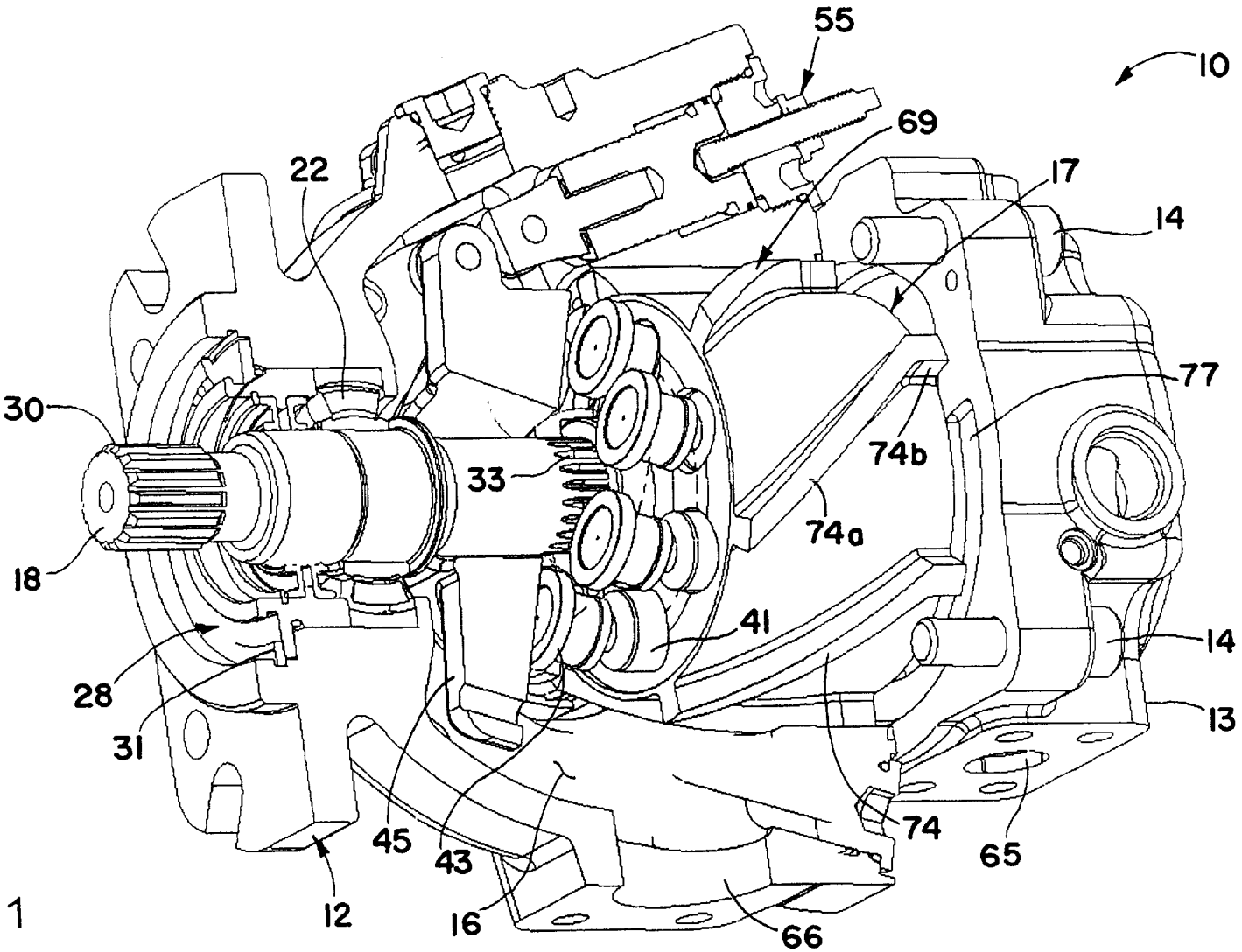
FIG. 1 is a perspective view, partly broken away in section, of a piston pump according to the invention.
Figure 2:
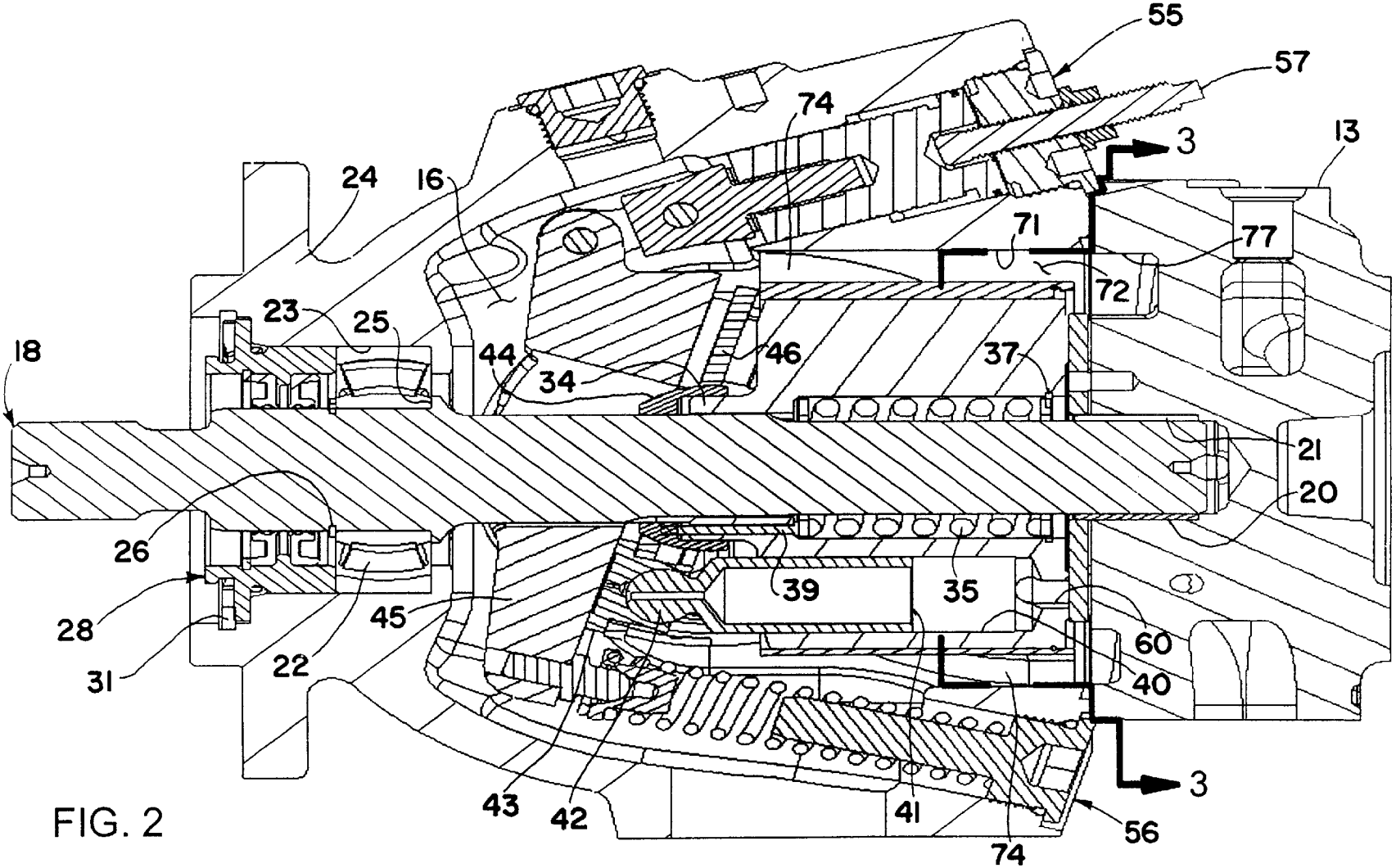
FIG. 2 is a longitudinal cross-sectional view of the pump of FIG. 1.

Referring now in detail to the drawings, and initially to FIGS. 1 and 2, an exemplary piston pump according to the invention is designated generally by reference numeral 10. The pump 10 includes a housing 12 and a rear port cover 13 fastened to the housing by bolts 14. The housing and rear port cover 13 together enclose a cavity 16 which houses a rotatable cylinder barrel 17.

The cylinder barrel 17 is mounted on a drive shaft 18 which is supported at its rear end by a bearing 20 fitted in a bore 21 in the rear port cover 13 and at its front end by a bearing 22 fitted in a bore 23 in an end wall 24 of the housing 12. Any suitable bearings may be employed, although in the illustrated pump the bearing 20 is a sleeve bearing or bushing while the bearing 22 is a self-aligning rotary bearing. As will be appreciated, the hydraulic loading is taken on the shaft bearings, this being in contrast to the piston pump shown in U.S. Pat No. 3,774,505 where hydraulic loading is taken on a barrel bearing journal.

The inner race of the rotary bearing 22 is retained on the drive shaft 18 and against a shoulder 25 on the drive shaft 18 by a retainer 26. The outer race of the bearing 22 is retained in the housing 12 between the bottom of the bore 23 and a seal and plug assembly 28. The seal and plug assembly 28 is retained in the bore 23 by a retainer 31. The seal and plug assembly closes the bore 23 which is open to the interior cavity 16 and seals against leakage along the drive shaft 18. As will be appreciated, the drive shaft may be extended through and beyond the rear port cover 13 for coupling to another component, such another pump. Thus, the present invention enables through-drive capability.

The drive shaft 18 has an external end portion 30 that is splined (as shown), keyed or otherwise configured for coupling to a prime mover (not shown) which rotatably drives the shaft for pumping fluid through the pump 10. The drive shaft also has an intermediate splined portion 33 in driving engagement with an internally splined hub portion 34 of the barrel 17 for transfer of rotary motion from the drive shaft to the barrel. The barrel, which is free to shift axially on the drive shaft, is biased by a spring 35 against a port plate 36 interposed between the barrel and port cover 13. As shown, the spring 35 is housed in a center bore in the barrel and is interposed between a retainer clip 37 fitted in a slot in the inner diameter wall of the barrel and a plunger 39 which for example consists of a washer and circumferentially spaced apart pins extending axially through the barrel hub portion.

The barrel 17 has a plurality of parallel bores 40 equally spaced circumferentially about its rotational axis. Each bore 40 receives a piston 41 that has a ball-shaped head 42 which is received in a socket of a shoe 43. Each shoe 43 is retained against a thrust or swash plate 45 by a shoe retainer plate 46. The shoe retainer plate 46 has a number of equally spaced holes, equal to the number of pistons 41, which passes over the body of each piston and engages a shoulder on each shoe. The retainer plate has a central opening at which it slidably engages a spherical outer surface of a guide hub 44. The guide hub 44 is telescopically supported on a forwardly projecting portion of the barrel hub 34 for relative axial movement. The spring 35 acts on the guide hub via the plunger 39, the plunger having a base portion upon which the spring acts and plural posts, for example three posts, which extend through holes in the barrel hub and protrude forwardly for engagement with the guide hub. Accordingly, the spring functions to bias not only the barrel against the port plate but also the retainer plate towards the swash plate.

The swash plate 45 may be fixed or formed integrally with the housing 12. However, usually the swash plate 45 is mounted in the housing for pivotal movement about an axis perpendicular to that of drive shaft. In the illustrated embodiment, the swash plate is supported by two half bearings in.the housing in a well known manner. This enables the angle of inclination of the swash plate to be varied with a corresponding change in the stroke or displacement of the pistons. In the illustrated embodiment, an adjustment mechanism 55 and preload mechanism 56 cooperate to hold the swash plate at a set inclination which may be varied by rotating an adjustment pin 57 accessible outside the housing 12. Other mechanisms may used as desired.

Figure 3:
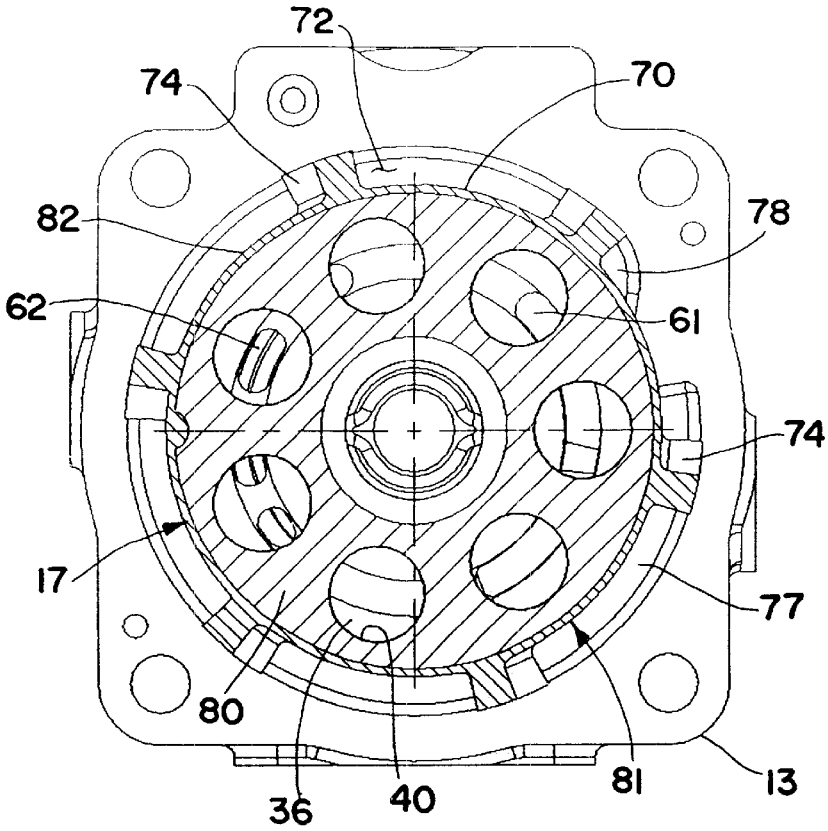
FIG. 3 is a transverse cross-sectional view of the pump of FIG. 1, taken along the line 3—3 of FIG. 2.

Referring additionally to FIG. 3, each cylinder bore 40 ends in a cylinder port 60, that conducts fluid between the piston bore and delivery and exhaust ports 61 and 62 in the port plate 36. Each cylinder port sequentially communicates with the delivery and exhaust ports during rotation of the barrel in a cylindrical barrel portion of the cavity 16. The exhaust port is in communication with an outlet port 65 formed in the port cover 13. The delivery port 61 is in communication with an inlet port 66 in the housing 12 via a front end portion of the barrel cavity 16 and an impeller pump chamber hereinafter discussed in detail.

Rotation of the drive shaft 18 by a prime mover, not shown, will rotate cylinder barrel 17. If swash (thrust) plate is inclined from a neutral position, i.e., normal to the axis of shaft, the pistons 41 will reciprocate as the shoes 43 slide over the thrust plate. As the pistons move away from port plate 36, low pressure fluid from the delivery port enters the cylinder bores. As the pistons move toward the port plate, they expel high pressure fluid into the exhaust port.

Rotation of the barrel 17 also imparts additional energy to the fluid in the delivery port by means of an impeller 69 which is integral with the barrel. As will be appreciated, the additional energy imparted by the impeller to the fluid in the delivery port prevents cavitation when the pump is driven at higher speeds than are normally possible on conventional pumps when the fluid in the inlet is not supercharged.

The barrel 17 has a radially outer surface 70 which is radially inwardly spaced from the cylindrical inner housing wall surface 71 (surrounding a barrel chamber) to form therebetween an impeller pump chamber 72. At least one and preferably a plurality of impeller vanes 74 (six in the illustrated embodiment) project radially outwardly from the outer wall surface 70 of the barrel and terminate at a radially outer vane edge adjacent the inner wall surface 71 of the barrel chamber. When the barrel rotates, axial fluid flow in the impeller pump chamber is induced by the impeller vanes.

The inlet end of the impeller pump chamber is in fluid communication with the front end (inlet) portion of the barrel chamber and an outlet end of the impeller pump chamber is in fluid communication with an annular discharge groove 77 in the port cover 13 that is axially aligned with and receives the output of the impeller pump chamber. The discharge groove 77 terminates at a relatively short volute that directs the fluid to the delivery port 61 in the port plate 36, whereby upon rotation of the barrel in the barrel chamber, low pressure fluid from the front end portion of the barrel chamber is supercharged by the impeller vane prior to passage through the delivery port. The discharge groove progressively increases in depth (or more generally in cross-sectional area) going towards the volute that leads to the delivery passage. This is advantageous for several reasons including the provision of a bigger reservoir that the fluid is pulled from, a decrease in the velocity of the fluid and improved flow compaction.

In the illustrated embodiment, each vane 74 extends the length of the barrel 17 and has a helical segment 74*a* and a straight segment 74*b*. The straight segment, which preferably is shorter than the helical segment, provides for axial redirection of the fluid flow towards the discharge groove 77.

In the illustrated embodiment, the barrel 17 includes a cylindrical core 80 including the piston bores 40 and an outer impeller sleeve 81 on the cylindrical core. The impeller sleeve includes the impeller vanes 74 and a hub 82 from which the vanes extend radially outwardly. The impeller sleeve may be molded as a unitary piece from a plastic material. Preferably, there is no axial vane overlap so the impeller can be molded in a two-part mold. The impeller sleeve may be secured to the barrel core by any suitable means.

Figure 4:
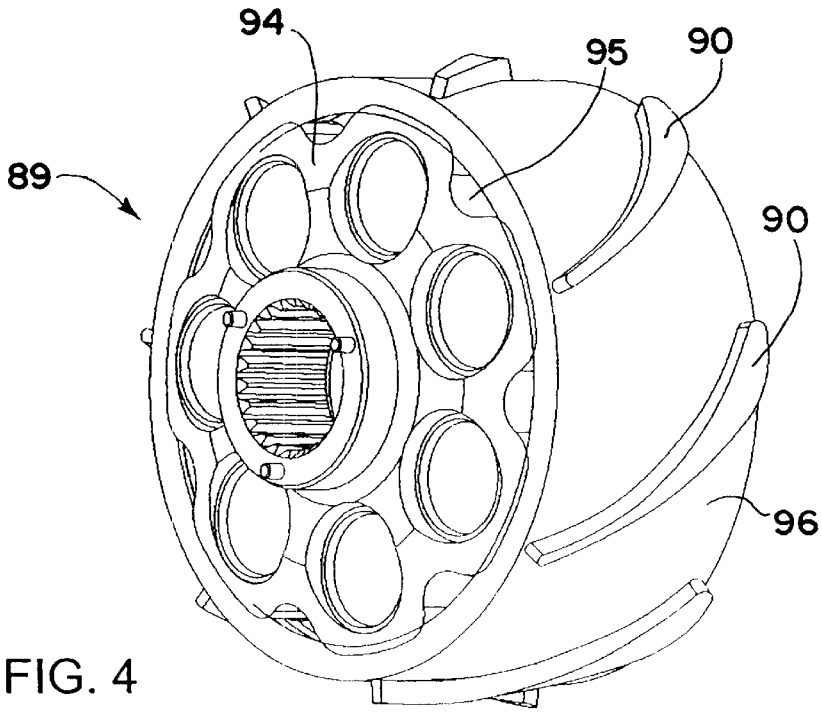
FIG. 4 is a perspective view of another form of cylinder barrel used in the pump of FIG. 1.

In FIG. 4, another embodiment of a barrel is indicated 89. The barrel 89 has an alternative form of vane 90. Each vane is helical and of progressively increasing circumferential width going from the inlet to the outlet end of the impeller pump chamber. Consequently, the circumferential spacing between relatively adjacent vanes progressively decreases going from the inlet to the outlet end of the impeller pump chamber. This decrease in spacing aids in accelerating the fluid through the impeller pump chamber.

As further illustrated in FIG. 4, the barrel core 94 may have on the radially outer side thereof a plurality of circumferentially spaced apart, axially extending grooves 95 for weight and material reduction. The impeller sleeve may be secured to the barrel core by any suitable means. For example the impeller sleeve may have a corresponding arrangement of ribs (not shown) on its radially inner diameter surface which circumferentially interlock mechanically with the grooves. The ribs may closely fit within the grooves to preclude any axial flow between the impeller sleeve and core.

In comparison to the piston pump shown in U.S. Pat. No. 3,774,505, which includes an internal precharger, a piston pump according to the present invention can attain a pressure boost of 9–10 psi relative to 0.5 to 1 psi for the prior art design of comparable size. The present invention also enables the impeller to be made of low cost materials that may have a lower strength than the barrel, whereas the impeller fins in the prior art design had to carry hydraulic loading. The present invention also enables enhancement of the flow configuration without the impeller is not a loading member.

Although the invention has been shown and described with respect to certain preferred embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. An axial piston fluid pump comprising:

a housing having an inner wall surface surrounding a barrel chamber and a port surface at a first end of the barrel chamber, the port surface including a delivery port and an exhaust port circumferentially spaced apart in relation to a center axis of the barrel chamber;

a barrel rotatably mounted within the barrel chamber in the housing and having a plurality of axially extending; circumferentially spaced piston bores therein, each piston bore having associated therewith a cylinder port in an end wall of the barrel located adjacent the port surface which cylinder port sequentially communicates with the delivery and exhaust ports during rotation of the barrel in the barrel chamber;

a plurality of pistons disposed in the piston bores for reciprocation; and a drive shaft for rotatably driving the barrel in the barrel chamber; and wherein:

the housing includes an inlet passage for delivering low pressure fluid to a second end of the barrel chamber opposite the port surface;

the barrel has a radially outer surface radially inwardly spaced from the inner wall surface of the barrel chamber to form an impeller pump chamber;

at least one impeller vane projects radially outwardly from the outer wall surface of the barrel and terminates at a radially outer vane edge adjacent the inner wall surface of the barrel chamber; and the impeller pump chamber has an inlet end in fluid communication with the second end of the barrel chamber and an outlet end in fluid communication with the delivery port, whereby upon rotation of the barrel in the barrel chamber, low pressure fluid from the second end of the barrel chamber is supercharged by the impeller vane prior to passage through the delivery port.

2. A pump as set forth in claim 1, wherein the drive shaft passes through the center of the barrel.

3. A pump as set forth in claim 2, wherein the barrel is axially slidable on the shaft.

4. A pump as set forth in claim 3, wherein the barrel is biased against the port surface.

5. A pump as set forth in claim 2, wherein the drive shaft is rotatably supported in the housing by bearings at opposite ends of the housing, which bearings carry the hydraulic loading acting on the barrel.

6. A pump as set forth in claim 1, wherein the at least one impeller vane includes a plurality of impeller vanes circumferentially spaced around the barrel.

7. A pump as set forth in claim 6, wherein each vane has a helical portion and an axial portion.

8. A pump as set forth in claim 6, wherein none of the vanes axially overlap an adjacent vane.

9. A pump as set forth in claim 6, wherein each vane is helical and of progressively increasing circumferential width going from the inlet to the outlet end of the impeller pump chamber, whereby the circumferential spacing between relatively adjacent vanes progressively decreases going from the inlet to the outlet end of the impeller pump chamber.

10. A pump as set forth in claim 1, wherein the port surface further has an annular discharge groove at the outlet end of the impeller pump chamber for receiving supercharged fluid and directing the supercharged fluid to the delivery port.

11. A pump as set forth in claim 10, wherein the discharge groove is connected to the delivery port by a volute.

12. A pump as set forth in claim 10, wherein the discharge groove progressively increases in cross-sectional area in the direction of rotation of the barrel.

13. A pump as set forth in claim 1, wherein the piston barrel comprises a core including a plurality of circumferentially spaced piston bores, and a sleeve surrounding the core, the sleeve including a cylindrical hub portion, and the at least one impeller blade projecting radially outwardly from the hub portion.

14. A pump as set forth in claim 13, wherein the hub portion and at least one impeller blade are formed as a unitary piece.

15. A pump as set forth in claim 13, wherein the sleeve is molded from plastic.

16. A pump as set forth in claim 13, wherein the core includes a plurality of circumferentially spaced apart grooves in the radially outer surface thereof.

17. A pump as set forth in claim 1, wherein the vane extends about the axial length of the barrel.

18. In an axial piston fluid pump, a housing having a cylindrical inner wall surface surrounding a barrel chamber; a barrel mounted for rotation within the barrel chamber in the housing and having a plurality of circumferentially spaced piston bores therein; and a plurality of pistons reciprocally movable in the piston bores for pumping fluid from a delivery passage to an exhaust passage; and the barrel having at least one impeller vane projecting radially outwardly and terminating at a radially outer vane edge adjacent the inner wall surface of the barrel chamber.

19. A pump as set forth in claim 18, wherein the piston barrel comprises a core including the piston bores, and a sleeve surrounding the core, the sleeve including a cylindrical hub portion, and the at least one impeller blade projecting radially outwardly from the hub portion.

20. A pump as set forth in claim 19, wherein the hub portion and at least one impeller blade are formed as a unitary piece.

21. A piston barrel for an axial piston fluid pump, comprising a core including a plurality of circumferentially spaced piston bores, and a sleeve surrounding the core, the sleeve including a cylindrical hub portion and at least one impeller blade projecting radially outwardly and terminating at a radially outer vane edge.

* * * * *